US005761640A

United States Patent [19]

Kalyanswamy et al.

[11] Patent Number: 5,761,640

[45] Date of Patent: Jun. 2, 1998

[54] NAME AND ADDRESS PROCESSOR

[75] Inventors: Ashok Kalyanswamy, Millwood; Edward Man, White Plains, both of N.Y.

[73] Assignee: Nynex Science & Technology, Inc., White Plains, N.Y.

[21] Appl. No.: 574,233

[22] Filed: Dec. 18, 1995

[51] Int. Cl.[6] ..... G10L 9/00

[52] U.S. Cl. ..... 704/260; 704/9; 704/270

[58] Field of Search ..... 395/2.69, 2.86, 395/2.79, 2.09, 2.75, 795, 759; 379/142, 127; 704/4, 9, 258

[56] References Cited

U.S. PATENT DOCUMENTS

| | | | |
|---|---|---|---|
| 3,704,345 | 11/1972 | Coker et al. | 179/1 SA |
| 3,739,348 | 6/1973 | Manly | 340/172.5 |
| 4,435,777 | 3/1984 | McCaskill et al. | 364/900 |
| 4,470,150 | 9/1984 | Ostrowski | 381/52 |
| 4,507,753 | 3/1985 | McCaskill et al. | 364/900 |
| 4,685,135 | 8/1987 | Lin et al. | 381/52 |
| 4,689,817 | 8/1987 | Kroon | 381/52 |
| 4,692,941 | 9/1987 | Jacks et al. | 381/52 |
| 4,754,485 | 6/1988 | Klatt | 381/52 |
| 4,783,810 | 11/1988 | Kroon | 381/52 |
| 4,783,811 | 11/1988 | Fisher et al. | 381/52 |
| 4,829,580 | 5/1989 | Church | 381/52 |
| 4,831,654 | 5/1989 | Dick | 381/51 |
| 4,896,359 | 1/1990 | Yamamoto et al. | 381/52 |
| 4,907,279 | 3/1990 | Higuchi et al. | 381/52 |
| 4,959,855 | 9/1990 | Daudelin | 379/213 |
| 4,979,216 | 12/1990 | Malsheen et al. | 395/2.69 |
| 5,036,539 | 7/1991 | Wrench, Jr. et al. | 395/2.55 |
| 5,040,218 | 8/1991 | Vitale et al. | 381/52 |
| 5,157,759 | 10/1992 | Bachenko | 395/2.75 |
| 5,163,083 | 11/1992 | Dowden et al. | 379/88 |
| 5,179,585 | 1/1993 | MacMillan et al. | 379/88 |
| 5,181,237 | 1/1993 | Dowden et al. | 379/88 |
| 5,181,238 | 1/1993 | Medamana et al. | 379/95 |
| 5,182,709 | 1/1993 | Makus | 364/419 |
| 5,204,905 | 4/1993 | Mitome | 381/52 |
| 5,367,609 | 11/1994 | Hopper et al. | 395/2.87 |
| 5,634,084 | 5/1997 | Malsheen et al. | 395/2.69 |

OTHER PUBLICATIONS

A. Kalyanswamy, K. Silverman, "Say What?–Problems in preprocessing names and addresses for text–to–speech conversion", AVIOS Proceedings 1991.

K. Silverman, A. Kalyanswamy, "Processing Information in Preparation for Speech Synthesis", 54th Annual Meeting of the American Society of Information Science, 1991 pp. 1–4,8,6.

A. Kalyanswamy, K. Silverman, S. Basson, D. Yashcin, "Preparing Text for a Synthesizer in a Telecommunications Application", Proceedings, IEEE International Workship on Telecommunications Applications of Speech, 1992.

S. Basson, D. Yashchin, K. Silverman, A. Kalyanswamy, "Assessing the Acceptability of Automated Customer Name and Address: A Rigorous Comparison of Text–to Speech Synthesizers", AVIOS Proceedings, 1991.

S. Basson, D. Yashchin, K. Silverman, A. Kalyanswamy, "Results from Automating a Name and Address Service with Speech Synthesis", AVIOS Proceedings, 1992.

(List continued on next page.)

*Primary Examiner*—David R. Hudspeth
*Assistant Examiner*—Donald L. Storm
*Attorney, Agent, or Firm*—Michaelson & Wallace; Peter L. Michaelson; John C. Pokotylo

[57] ABSTRACT

A name and address processor for processing text contained within an existing database for subsequent text-to-speech synthesis. The processor receives as input a listing contained within a textual source database, intelligently recognizes any fields contained within the textual source, normalizes the text contained within the fields, detects acronyms contained within the fields, identifies and marks any particular textual entries as necessitating spelling and then formats the processed text for output to a text-to-speech synthesizer. The processor processes in parallel all name field entries, address field entries, and locality field entries using tables of rules as well as both regular expression and non-regular expression methodologies.

8 Claims, 16 Drawing Sheets

OTHER PUBLICATIONS

S. Basson, D. Yashchin, K. Silverman, J. Silverman, A. Kalyanswamy, "Synthesizer Intelligibility in the Context of a Name–and–Address Information Service", EUROSPEECH Proceedings, 1993.

S. Basson, D. Yashchin, K. Silverman, A. Kalyanswamy, "Comparing Synthesizers for Name and Address Provisions: Field Trial Results", EUROSPEECH Proceedings, 1993.

S. Basson, D. Yashchin, K. Silverman, J. Silverman, A. Kalyanswamy, "Comparing Synthesizers for Name and Address Provision", AVIOS Proceedings, 1993.

```
/*
*   The data strutures are used to send a NORMALIZED_ ADDR TEXT
*   command.
*/

struct   NormalizeAddrCmdData
{
702 PhoneNum    telephone_num;   //10digit telephone number
704 StreetName  addr;            //The complete street address.

/*
*
*   In many applications, we know the various components
*   of the address;

706 HouseNum    house_num:       //Char instead of int because
                                 //house num could be 12A,
                                 //N,NE,etc.

708 StreetName  streetname;
710 StreetType  street_type;     //e.g.,ST, Street, Avenue, PKWY
712 StreetSuffix street_suffix;  //e.g.,EXTENSION
}
```

FIG. 7

```
/*
*    The data strutures are used to send a
*    NORMALIZE_LOCALITY_TEXT command.
*/

struct    NormalizeLocalityCmdData
{
802  PhoneNum     telephone_num;   // 10 Digit telephone number.
804  CityName     city;
806  StateName    state;
808  ZipCode      zip_code;        //5 digit zip-code
     ZipCodeExt   zip_plus_four;   //last 4 digits in a zip + four
810                                //entry.
}
```

FIG. 8

```
/*
*     These data structures are used to send a
*     NORMALIZE_NAME_TEXT command.
*/                                                                    900
struct      NormalzeNameCmdData
{
        /*
        *     Certaion applications have numbers appended/prepended
        *     to the telephone number field, which endoce the application
        *     specific information. This information will be passed
        *     untouched to the output collater.
        */
902     PhoneNumInfo            phone_number_info;
904     PhoneNum                telephone_num;
        /*
        *     In some applications, it may be necessary to do
        *     synthesizer-specific processing.
        */
906     Synth_Name              synthesizer_name;
908     Listin_Name             listing_name;           // Hold the whole name field.
910     Boolean                 found_joint_name;       // Joint name?
        /*
        *     in some applications, the name field is pre-split into
        *     family/given name fields.
        */
912     LastName                family_name;
914     FirstName               given_name;
        /*
        *     In some applications, the name field may have links.
        */
916     DBALink                 DBA_link;               //Doing Business As Link.
918     CareOfLink              care_of_link;           // Care Of Link.
920     AttentionLink           attention_link;         // Attention Of Link.
        /*
        *     In some applications, there may be additional information, i.e.,
        *     hours of business, etc.
        */
922     DirectiveText           directive_text;
        /*
        *     What do we know about the type of listing ?
924     */
        ListingType             listing_type;
}
```

FIG. 9

```
/*
*       This data structure includes all of the command components. It
*       may be used to send any command.
*/

union           Command
{
        MsgHdr                          hdr;
        GenericCmd                      generic;
        NormalizeNameCmd                normalize_name;
        NormalizeAddrCmd                normalize_addr;
        NormalizeLocalityCmd            normalize_locality;
        DetectNameAcronymCmd            detect_name_acronym;
        MarkSpellNameCmd                mark_spell_name;
        FormatNameOutputCmd             format_name_output;
        DetectAddrAcronymCmd            detect_addr_acronym;
        MarkSpellAddrCmd                mark_spell_addr;
        FormatAddrOutputCmd             format_addr_output;
        DetectLocalityAcronymCmd        detect_locality_acronym;
        MarkSpellLocalityCmd            mark_spell_locality;
        FormatLocalityOutputCmd         format_locality_output;
        ParseListingCmd                 parse_listing;
        SpeakAsIsCmd                    speak_as_is;
        DisplayListingCmd               display_listing;
        Command&                        operator=( const Command& );
}
```

FIG. 10

```
/*
*       This data structure includes all of the responses to a command. It
*       may be used to send any response.
*/

union           Response
{
        MsgHdr                          hdr;
        RspHdr                          rsp_hdr;
        GenericRsp                      generic;
        NormalizeNameRsp                normalize_name;
        NormalizeAddrRsp                normalize_addr;
        NormalizeLocalityRsp            normalize_locality;
        DetectNameAcronymRsp            detect_name_acronym;
        MarkSpellNameRsp                mark_spell_name;
        FormatNameOutputRsp             format_name_output;
        DetectAddrAcronymRsp            detect_addr_acronym;
        MarkSpellAddrRsp                mark_spell_addr;
        FormatAddrOutputRsp             format_addr_output;
        DetectLocalityAcronymRsp        detect_locality_acronym;
        MarkSpellLocalityRsp            mark_spell_locality;
        FormatLocalityOutputRsp         format_locality_output;
        ParseListingRsp                 parse_listing;
        SpeakAsIsRsp                    speak_as_is;
        DisplayListingRsp               display_listing;
        Command&                        operator=( const Command& );
}
```

FIG. 11

```
#
#       FILE: parser.config
#
#       The following variables determine which system specific code
#       should be enabled
#
REGION0 = TRUE
REGION1 = FALSE
REGION2 = FALSE

APPLICATION0 = TRUE
APPLICATION1 = FALSE
APPLICATION2 = FALSE
#
#       Table file directories for regular/nonregular expressions
#
NAP TABLE DIR =/home/NAP/data/table
NTN_POSTPROC_NOREGEXP=/home/NAP/data/table/name_post_noreg.text
NTN_POSTPROC_REGEXP=/home/NAP/data/table/name_post_reg.text
NTN_PREPROC_NOREGEXP=/home/NAP/data/table/name_pre_noreg.text
NTN_PREPROC_REGEXP=/home/NAP/data/table/name_pre_reg.text
#
#       Config variables for Namefield Acronym Detection (NAD)
#
NAD_LOWERCASE_ACRONYMS = TRUE
NAD_CONTAINS_STARS = TRUE
NAD_INSERT_SPACES_ACRONYMS = FALSE

NAD_MERGE_SPLIT_WORDS_AND_ACRONYMS = TRUE
NAD_DETECT_ACRONYM_LISTING_NAME = FALSE
NAD_DETECT_ACRONYM_FAMILY_NAME = TRUE
NAD_DETECT_ACRONYM_GIVEN_NAME = TRUE
NAD_DETECT_ACRONYM_DBA_LINK = TRUE
NAD_DETECT_ACRONYM_CARE_OF_LINK = FALSE
NAD_DETECT_ACRONYM_ATTENTION_LINK = FALSE
NAD_DETECT_ACRONYM_DIRECTIVE_TEXT = FALSE

NAD_BUSINESS_INDICATORS =/home/NAP/data/bus_ind.text
NAD_KNOWN_ACRONYMS =/home/NAP/data/known_acronym.text
NAD_PRONOUNCEABLE_ACRONYMS =/home/NAP/data/npa.text
NAD_ALLOW_INIT_2LET_CLUSTERS =/home/NAP/data/ai2lc.text
NAD_INIT_2LET_CLUSTERS =/home/NAP/data/i2lc.text
NAD_FINAL_2LET_CLUSTERS = /home/NAP/f2lc.text
```

FIG. 12a

```
#
#       FILE: parser.config (cont)
#

#
#       Config variables for Addressfield Text Normalization (ATN)
#
ATN_ADDRESS_POST_NOREGEXP = /home/NAP/data/add_post_noreg.text
ATN_ADDRESS_POST_REGEXP = /home/NAP/data/add_post_reg.text
ATN_ADDRESS_PRE_NOREGEXP = /home/NAP/data/add_pre_noreg.text
ATN_ADDRESS_PRE_REGEXP = /home/NAP/data/add_pre_reg.txt

ATN_STREET_ABBREV = /home/NAP/data/atn_street_abb.txt
ATN_SING_STREET_ABBREV = /home/NAP/data/atn_sing_street_abb.text
ATN_UNABBREV_STREET_NAM = /home/NAP/data/atn_unabbrev_street.text
ATTN_STREET_DICT = /home/NAP/data/atn_street_dict.text
#
#       Config variables for Addressfield Acronym Detection (AAD)
#
AAD_LOWERCASE_ACRONYMS = TRUE
AAD_CONTAINS_STARS = TRUE
AAD_INSERT_SPACES_ACRONYMS = TRUE

AAD_KNOWN_ACRONYMS = /home/NAP/data/aad_known_acronyms.text
AAD_PRONOUNCEABLE_ACRONYMS = /home/NAP/data/aad_pron_acro.text
AAD_ALLOW_INIT_2LET_CLUSTERS = /home/NAP/data/aad_ai2lc.text
AAD_ALLOW_FINAL_2LET_CLUSTERS = /home/NAP/data/aad_af2lc.text
AAD_ALLOW_2LET_WORDS = /home/NAP/data/aad_a2lw.text
#
#       Config variables for Addressfield Spell Marking (ASM)
#
ASM_MARK_SPELL_ADDR = FALSE
ASM_MARK_SPELL_STREET = TRUE

ASM_WORDS_NO_SPELL = /home/NAP/data/asm_words_nospell.text
ASM_COMMONS_FIRST_NAMES = /home/NAP/data/asm_com_first_name.text
ASM_BUSINESS_INDICATORS = /home/NAP/data/asm_business_ind.text
#
#       Config Variables for Localityfield Text Normalization (LTN)
#
LTN_CITY_ABBREV = /home/NAP/data/ltn_city_abbrev.text
LTN_2WORD_CITY = /home/NAP/data/ltn_2word_city.text
LTN_CITY_SUFFIX = /home/NAP/data/ltn_city_suffix.text
LTN_KNOWN_ACRONYMS = /home/NAP/data/ltn_known_acro.text
LTN_PRONOUNCEABLE_ACRONYMS = /home/NAP/data/ltn_pron_acro.text
```

FIG. 12b

```
#
#       ST_Rules.text
#
PROVIDENCE ST:PROVIDENCE STREET
LA SALLE ST:LAsalle STREET
LA sALLE ST:LAsALLE STREET
LAsALLE ST:LAsALLE STREET
CONVENT ST:CONVENT STREET
MAIN ST:MAIN STREET
STATE ST:STATE STREET
WALL ST:WALL STREET
BANK ST:BANK STREET
CHURCH ST:CHURCH STREET
DISCOUNT ST:DISCOUNT STORE
EAST ST:EAST STREET
E ST:EAST STREET
SOUTHEAST ST:SOUTHEAST STREET
SE ST:SOUTHEAST STREET
NORTHEAST ST:NORTHEAST STREET
NE ST:NORTHEAST STREET
SOUTHWEST ST:SOUTHWEST STREET
SW ST:SOUTHWEST STREET
NORTHWEST ST:NORTHWEST STREET
NW ST:NORTHWEST STREET
NORTH ST:NORTH STREET
NO ST:NORTH STREET
N ST:NORTH STREET
SOUTH ST:SOUTH STREET
SO ST:SOUTH STREET
S ST:SOUTH STREET
```

FIG. 13a

```
#
#       Special_character_rules.text
#       What is done with special characters
        _NULL_implies the string"";_SPACE_implies the string" ";
#@(\.):_SPACE_
#@(\).,
#@(\{):NULL
#@(\}):_NULL_
#@(\!):1
#@(\-):_SPACE_
#@(\<):_NULL_
#@(\>):_NULL_
#@(\=): EQUALS
#@(\^):_NULL_
#@(\|):_NULL_
#@(\():_SPACE_
#@(\)):_SPACE_
#@(\]):_NULL_
#@(\[):_NULL_
#@(\_):_SPACE_
#@(\?):_SPACE_
#<0>() (AND)_NULL_
#<0>@:_NULL_
#@<~0>: NULL
@:AT
```

FIG. 13b

```
#       Skolotal processor regexp.text
#

((RL)|(RE)) (EST) (A) {0,1} (T) {0,1} (E) {0,1}:REAL ESTATE
JUS(T) {0,1} (I) {0,1} (C) {0,1} (E) {0,1} ((OFC)|(OFF)|(OFFICE)):JUSTICE OFFICE
((AND)|(&))C()<-0>:AND COMPANY
CARPET CLE(A) {0,1}:CARPET CLEANERS
bu()+<-0>BUREAU
(STATE) (POL(I) {0,1} (C) {0,1}):STATE POLICE
LIFE(INS) (U) {0,1}R{0,1} (A) {0,1} (N) {0,1} (C) {0,1}:LIFE INSURANCE
TRADE PUBL(I) {0,1} (C) {0,1} (A) {0,1} (T) {0,1} (O) {0,1}:TRADE PUBLICATIONS
BRADFORD(\*)BRADFORD
(COPY) () (\*) {0,1} (I) (\*) {0,1}:COPY 2
(\*) {0,1} (I) (\*) (I) (\*) (I):THE THIRD
(\*) {0,1} (I) (\*) (I):THE SECOND
<0>()*CO OF:COUNTY OF
(ASSO) {0,1} (C) {0,1} (I) {0,1} (A) {0,1} (T) {0,1} (I) {0,1} (O) {0,1} () OF:ASSOCIATION OF
HOUSING AUTH (O) {0,1} (R) {0,1} (I) {0,1} (T) {0,1}:HOUSING AUTHORITY
#
#Region Specific Stuff
#
NEW Y(O) {0,1}R{0,1}:NEW YORK
(N|NORTH) () (BERK):NORTH BERKSHIRE
(NH)(\\) (VT):NEW HAMPSHIRE VERMONT
N(\*)H(\):NEW HAMPSHIRE
(WA) (\\) (HINGTON):WASHINGTON
((I)|(IN)) ()*<~0>:INCORPORATED
(MA) ()*<~0>:MASSACHUSETTS
(NY) ()*<~0>:NEW YORK
(ME) ()*<~0>:MAINE
(VT) ()*<~0>:VERMONT
(RI) ()*<~0>:RHODE ISLAND
(FRANK(\;) (IN):(FRANKLIN)
DONA(L) {0,1} (\;)D:DONALD
DO(\;)NALD:DONALD
HUNT(L) {0,1} (\;)Y:HUNTLEY
G(L) {0,1} (\;)ADYS:GLADYS
RECT(\;)Y:RECTORY
KIMBER(L) {0,1} (\;) (Y):KIMBERLY
A(L) {0,1}ESSI:ALESSI
E(L) {0,1} (\;)SIE:ELSIE
JOCE(L) {0,1} (\;)YNE:JOCELYNE
(\;)S():'S
(\;) ():_SPACE_
() (\;):_SPACE_
(\;):_SPACE_
(\'S) () (COR) ()+<~0>:'S CORNER
(\*)(INC):INC
```

FIG. 13c

NAME AND ADDRESS PROCESSOR

TECHNICAL FIELD

The invention relates generally to the field of speech synthesis, and in particular to a method and apparatus for synthesizing speech from text which is generated by, and organized for visual processing by humans, and not machines, i.e., computers.

DESCRIPTION OF THE PRIOR ART AND PROBLEM

Systems incorporating text-to-speech synthesizers coupled to a database of textual data are well known and find an ever-increasing variety of applications. Such systems include telephonic answering and voice-messaging systems, voice response systems, monitoring and warning systems and entertainment systems.

Given the wide applicability of speech synthesis systems to everyday life, much prior effort has been expended to make the output of speech synthesis systems sound more "natural", i.e., more like speech from a human and less like sound from a computer.

Toward this end of realizing more human-like speech, the prior art has focused on techniques for converting input text into a phonetic representation or pronunciation of the text which is then converted into sound. One such prior art technique uses a fixed dictionary of word-to-phonetic entries. Such fixed dictionaries are necessarily very large in order to handle a sufficiently large vocabulary, and a high-speed processor is necessary to locate and retrieve entries from the dictionary with sufficiently high-speed. To help avoid the drawbacks associated with fixed dictionary systems, other techniques such as that disclosed in U.S. Pat. No. 4,685,135 to Lin et al, use a set of rules to convert words to phonetics.

While such prior art techniques do enhance the quality of the speech synthesized from a well-defined collection of text, many real applications of speech synthesis technology require machines to convert text from existing, and previously-populated databases to synthesized speech. As described by Kalyanswamy, A., Silverman, K., Say What?—Problems in precrocessing names and addresses for text-to-speech conversion, AVIOS Proceedings, 1991, these databases have been manually entered (typed) by humans and were intended to provide a visual display of data contained within. If the text within such a database is to be converted to speech by a speech synthesizer, a number of serious problems quickly emerge, namely: 1) Delimiting meaningful units in the database text; 2) Identifying and expanding of abbreviations used in the database text; and 3) Detecting acronyms in the database text.

A. Delimiting Meaningful Units in the Input Text

Among the terms used in conjunction with the present invention is "phoneme" which refers to a class of phonetically similar speech sounds, or "phones" that distinguish utterances, e.g., the /p/ and /t/ phones in the words "pin" and "tin", respectively.

The term "prosody" refers to those aspects of a speech signal that have domains extending beyond individual phoneme's. A prosody is characterized by variations in duration, amplitude and pitch. Among other things, variations in prosody cause a hearer to perceive certain words or syllables as stressed. Prosody is sometimes characterized as having two distinct parts, namely "intonation" and "rhythm". Intonation arises from variations in pitch and rhythm arises from variations in duration and amplitude. Pitch refers to the dominant frequency of a sound perceived by an ear, and it varies with many factors such as the age, sex, and emotional state of a speaker.

If the text to be synthesized does not have prosodic boundaries explicitly marked, the intended meaning of the synthesized utterance can change and result in poor synthesis. The text in many large databases is organized in fixed-width physical fields. Many applications demand that these fields be read out in sequential order, but the prosodic boundaries will not always correspond to the physical boundaries. In a typical application, i.e., Customer Name and Address, the prosodic boundaries should occur after the logical fields of name, address, city state and zipcode.

For example, if one considers a sample listing from a customer name and address database which contains the following line of literal data:

4135551212 WALL ST SECU COR RT 24 E BOSTON, MASS

One possible interpretation of this listing might be: Wall Street Securities, Corner of Route 24, East Boston, Mass. Unfortunately, a complex domain-specific knowledge of the listing is required to produce a correct interpretation of the listing. A correct interpretation of this listing would therefore be: Wall Street Securities Corporation, Route 24 East, Boston, Mass.

If this listing were interpreted as in the first instance above and then sent to a speech synthesizer, a person listening to the synthesized speech would be mislead with both wrong words and wrong prosody. One very important deficiency of prior-art speech synthesis systems is their inability to correctly delimit text into meaningful units.

This deficiency of prior-art systems is compounded because many existing databases which provide input data to speech synthesis systems do not have any explicit markings to identify the fields, i.e., name, address, city, state and postal zip code. One particular problem with such existing databases is that a single physical field may map onto one of many logical fields. To illustrate this point, a set of possible contents of the physical fields in an existing record are shown in Table 1.

TABLE 1

| Physical Field | field 1 | field 2 | field 3 | field 4 |
|---|---|---|---|---|
| Logical Field | name | more name<br>address<br>city,state,zip | address<br>more address<br>city,state,zip<br>more name | city,state,zip<br>more name<br>misc. |

Furthermore, it is important to note that in the example above showing the logical and physical fields contained in an existing, representative database, any or all of the fields (i.e., city, state, or zip) may be missing.

Consider, for example, the following 2 listings contained in Table 2:

TABLE 2

| Physical Field | field 1 | field 2 | field 3 | field 4 |
|---|---|---|---|---|
| Listing #1 | John Smith | Mary Allen | 10 Main St | NY, MY |
| Listing #2 | John Smith | NYNEX SCI & TEC | 10 Main St | NY, NY |

When this information is presented on a screen, i.e., a computer cathode-ray-tube or CRT, an operator may easily distinguish that the first listing (Listing #1) should be interpreted as John Smith & Mary Allen at 10 Main Street, New York, N.Y. Similarly, the operator would know that the second listing (Listing #2) should be interpreted as John Smith at NYNEX Science and Technology, New York, N.Y. In a situation such as the one depicted, above in Table 2, the task of a computer based name and address processor is to determine where the name stops and the address begins.

Mapping between physical and logical fields is even more problematic when one physical field contains sub-parts of two logical fields. For example, a parser must be able to correctly map "SANFRANCISCOCA", into San Francisco, Calif., but at the same time avoid incorrectly mapping "SANFRANCISCO" into San Francis, Colo.

Additionally, a problem arises when key-words are allowed to belong to two semantic classes. For example, assume that the word "PARK" is a key-word that we are looking for. Finding "CENTRAL PARK" and labeling it as an address is correct in certain instances, however, labeling a field containing the town name "COLLEGE PARK" as an address would not be proper. Subsequent to the initial labeling, the city and state must be identified and separated from the "city-state" field, if in fact both exist.

B. Text Substitution

Text-to-speech synthesizers typically expand abbreviations, based upon some general rules and/or look-up tables. While this is adequate for some limited applications, a large data base often contains abbreviations which are extremely context sensitive and, as such, these abbreviations are often incorrectly expanded by unsophisticated methods which only employ simple rules or tables.

As previously stated, the text found in most information retrieval systems is intended to be presented visually. A person observing information so presented can detect, disambiguate and correctly expand (hopefully) all of the abbreviations. Automating this process is difficult.

This problem of expanding abbreviations can be better understood by characterizing the problem into two distinct categories. The first of these categories involves "standard" or "closed class" abbreviations. Such abbreviations include "DR, JR, ROBT, and ST", among others. For example, if one assumes that the abbreviation "ST", found in a name position expands to Saint, as would be done by a prior-art synthesizer system, then names such as "ST PAUL" would likewise be expanded correctly. However, if that same expansion methodology were applied to, e.g., "ST OF ME ST HSE ST", which should expand to State of Maine, State House Station, it would fail miserably.

A further example of a standard abbreviation text substitution and expansion that demonstrates the difficulty associated with prior-art text-to-speech synthesizers is the letter "I" which often occurs in the end of a name field. Such an occurrence could be interpreted as The First, as in "JOHN JACOB I" or alternatively, Incorporated, as in "TRISTATE MARBLE ART I". To correctly interpret either of these two examples, a text-to-speech synthesizer must correctly determine the context in which the "I" is used.

A second category of abbreviations is the "Non-standard" or "open class" of abbreviations and truncations. Members of this category are oftentimes created by users of an information management system who input the data and truncate/abbreviate some word to fit in a physical field. For example, the word Communications has been abbreviated in existing databases as "COMMNCTNS, COMNCTN, COMMICATN or COMM" and about 20 other variations as well. Yet COMM has also been used for Committee, Common, Commission, Commissioner and others. A more domain specific example from this open class category is "WRJC" which would normally be expanded as the name of a radio station (i.e., an unpronounceable 4-letter sequence beginning with a "W"). However, some databases would contain this 4-letter sequence signifying the city, White River Junction, in the state of Vermont.

C. Acronyms

While a human would have no problem recognizing that certain character sequences such as NYNEX and IBM are acronyms, a computer is not so adept. In particular, one of the many ways in which humans identify such character sequences as acronyms is that the character sequences are oftentimes displayed in a distinguishing font, i.e., all capitals. However, many existing databases contain text which is entirely in an all upper case font, thereby making the acronyms contained within indistinguishable in appearance from normal text.

Compounding this problem of indistinguishable acronyms is the fact that some acronyms such as NYNEX should be pronounced as a single spoken word while others such as IBM should be spoken as three, separate letters. Therefore, even if a system were to correctly determine which particular character sequences contained within a database were acronyms, the system oftentimes fails in identifying which particular acronyms require spelling-out, i.e., IBM.

It is desirable therefore to efficiently, automatically, and expeditiously pre-process the data contained within an existing database for subsequent presentation to a text-to-speech synthesis system such that fields within the database are intelligently recognized; any text contained within the fields is properly normalized; acronyms are detected; and words which are to spelled during speech are identified

SOLUTION

The above problem is solved and an advance is made over the prior art in accordance with the principles our invention wherein an unattended, automated processor, quickly, efficiently and accurately pre-processes textual data contained within an existing database for subsequent presentation to a text-to-speech synthesizer such that the resultant speech is enhanced. The invention scans an input listing from a textual source database, intelligently recognizes any field(s) contained within the textual source, normalizes the text contained within the field(s), detects acronyms contained within the fields, identifies and marks particular textual entries as necessitating spelling and then formats the processed text for output to a text-to-speech synthesizer.

BRIEF DESCRIPTION OF THE DRAWINGS

FIG. 7 shows the data structures for normalizing address text;

FIG. 8 shows the data structures for normalizing locality text;

FIG. 9 shows the data structures for normalizing name text;

FIG. 10 shows a generalized data structure which contains the data structures of FIGS. 7, 8 and 9;

FIG. 11 shows a generalized data structure for responses to commands invoked through the data structure of FIG. 10;

FIG. 12*a* shows a first half of a skeletal configuration file used by the present invention;

FIG. 12*b* shows a second half of a skeletal configuration file used by the present invention;

FIG. 13*a* shows a skeletal table of "ST" expansion;

FIG. 13*b* shows a skeletal table of special characters expansion; and

FIG. 13*c* shows a skeletal table of regular expression expansion.

To facilitate reader understanding, identical reference numerals are used to denote identical or similar elements that are common to the figures. The drawings are not necessarily to scale.

DETAILED DESCRIPTION

I will now describe a preferred embodiment of the invention while referring to the figures, several of which may be simultaneously referred to during the following description.

Figure 1:
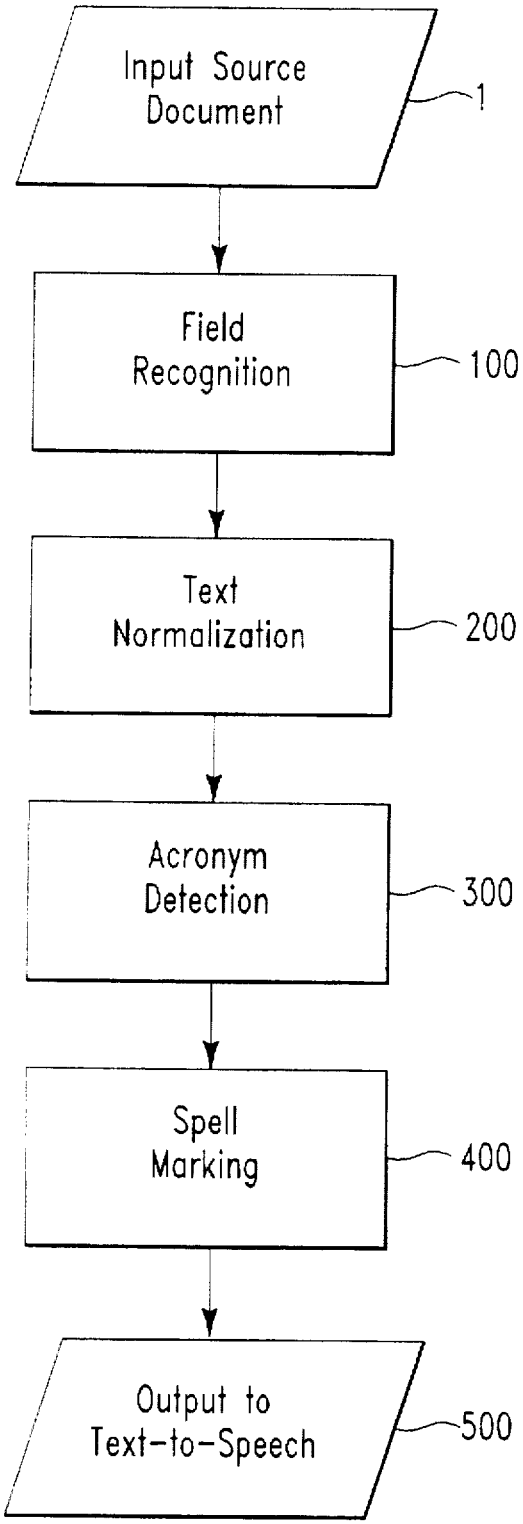
FIG. 1 is a flow diagram showing the generalized processing of an input source document through text-to-speech output.

FIG. 1, shows a flowchart which depicts the processing of text residing in a data base and subsequent output of the processed text to a text-to-speech device.

Specifically, execution first proceeds with block 1, where source documents containing unprocessed text residing in a data base are input. After the source has been input, execution proceeds to block 100, where the source is parsed and fields contained therein are recognized. The text contained within the fields is normalized by the execution of block 200. Subsequently, block 300 is executed where acronyms are detected within the normalized text. Block 400 is then executed and words which are to be spelled-out, i.e., I.B.M. are marked. Lastly, block 500 is executed and the now input, field recognized, normalized, acronym-detected and spell-marked text is output to a text-to-speech device.

Figure 2:
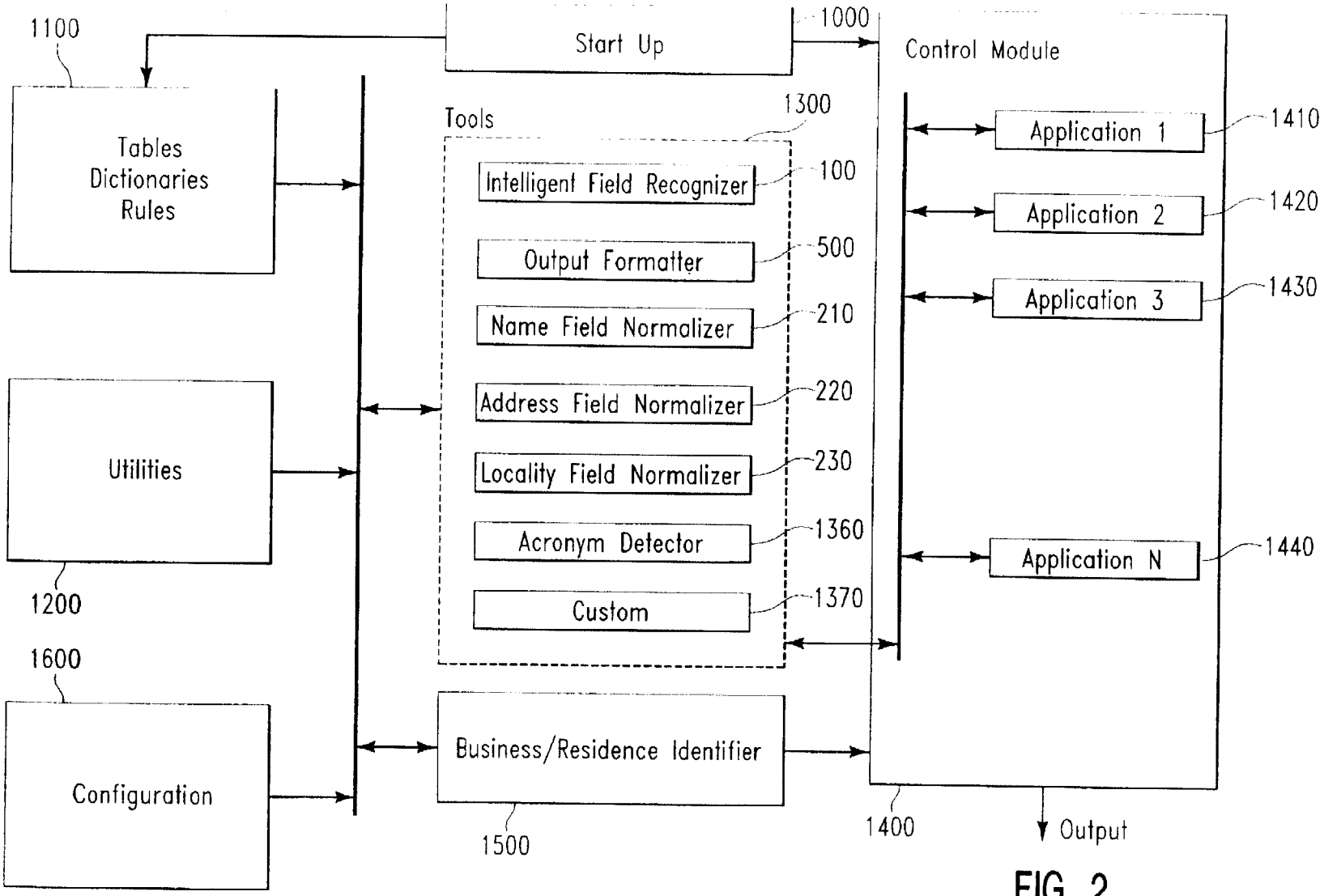
FIG. 2 is an architectural block diagram showing the components of the present invention.

FIG. 2 shows a block-level architectural diagram of the present invention. Start-up module 1000, initializes the other modules, e.g., control module 1400. The control module serves as an interface between tools 1300, and any applications, e.g., application 1, 1410, application 2, 1420, application 3, 1430, and application N, 1440 which employ those tools to perform their application-specific requirements.

Tool modules which are utilized by one or more applications include Intelligent Field Recognizer 100, NameField Normalizer 210, AddressField Normalizer 220, Output Formatter 500, LocalityField Normalizer 230, Acronym Detector 1360, and/or any other Custom module(s) 1370 as well as Business/Residence Identifier 1500.

The Intelligent Field Recognizer module 100, maps the content of fixed-width physical fields contained within a data-base to a set of logical fields, namely, Name, Address, City, State and Zip-Code. With some applications, the mapping of fixed-width physical fields to logical fields, i.e., Name, Address, City, State, and Zip Code could be characterized as: one-to-one (one physical field maps onto one logical field); many-to-one (two or more physical fields map onto one logical field); and in some cases other than the usual city-state-zip combination, one-to-many (one physical field contains sub-parts of two logical fields). The Intelligent Field Recognizer Module accepts a complete original listing from the database together with field-width information provided by the Control Module, parses the listing, and outputs labeled logical fields. The input to, and corresponding output of, two sample listings processed by the Intelligent Field Recognizer Module is shown in examples 1 and 2, respectively.

| INPUT | OUTPUT |
|---|---|
| | Example 1. |
| 8025550001<br>WM DOUGLAS ROBINSON DBA<br>ROBINSON AUDIO<br>+VDO<br>120 ST PAUL ST<br>WRJC, VT 05020 | telephone: 8025550001<br>name: WM DOUGLAS<br>ROBINSON DBA ROBINSON<br>AUDIO + VIDEO<br>address 120 ST PAUL St<br>city: WRJC<br>state: VT<br>zip-code: 05020 |
| | Example 2. |
| 2125559200<br>WSKQ SPANISH<br><br>BROADCASTING<br>26 W 56<br>FLR 5 *10019 | telephone: 2125559200<br>name: WSKQ SPANISH<br>BROADCASTING<br>address 26 W 56, FLR 5<br>zip-code: 10019 |

The name fields of Examples 1 and 2 illustrate a many-to-one mapping from physical fields to logical fields. The first two fields of the listings (after the telephone number field) form the logical name field. The street address field in Example 1 is an instance of one physical field mapping to one logical "address" field. The last field of Example 2 is an instance of a one-to-many mapping, that is, one physical field contains a sub-part of the address field, plus the zip-code, an unrelated logical field. Example 2 also illustrates an instance where some of the fields (in this case the city and state) are missing.

Regardless of the contents of a particular entry, the Intelligent Field Recognizer Module 100 must determine whether any characters following a first name field is an extension of the name, a first part of an address, or a city/state identifier. The Intelligent Field Recognizer Module 100 uses a database of key words in semantic classes (e.g., street-address, business) for disambiguating and correctly tagging text contained in a listing.

The Business-Residence Identifier module 1500, accepts an alphanumeric string and identifies whether the string represents a "business" or a "residence." This module uses a database of key-words 1100, in combination with a set of rules (e.g., presence of an apostrophe "'", as in DENNY'S PLACE) to decide whether an input string of an entry belongs to a class "BUSINESS" and returns a Boolean, set to TRUE or FALSE accordingly. In Examples 1 and 2 above, the presence of key words AUDIO and BROADCASTING, identify them as business listings, respectively.

Figure 3:
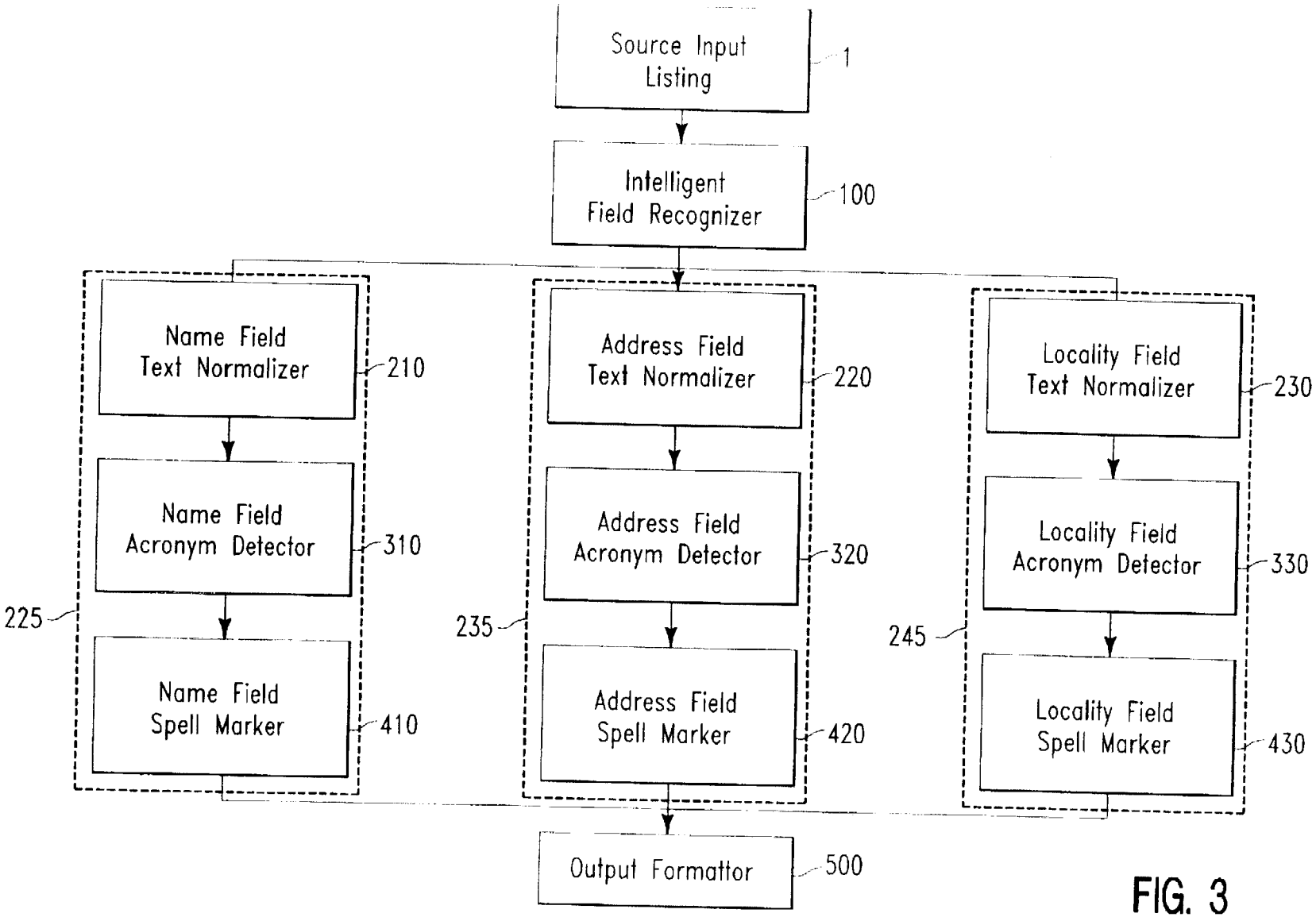
FIG. 3 is a flow diagram showing name, address and locality fields processed in parallel according to the flow of FIG. 2.

With reference to FIG. 3, upon the completion of processing by Intelligent Field Recognizer module 100, a command structure is constructed having members which are populated for processing through separate branches, namely a NameField Branch 225, AddressField Branch 235, and LocalityField Branch 245. Due to this logical separation of the three branches, parallel processing of the NameField, AddressField and LocalityField is realized.

Through a variety of mechanisms available in contemporary computer operating systems, e.g., a fork system call available in the UNIX®Operating System, processes which perform the operations in each of the separate branches are invoked in parallel. Once invoked, these NameField, AddressField, and LocalityField processes await receipt of generalized commands containing the structure populated by the Intelligent Field Recognizer for appropriate processing.

FIG. 10 shows a generalized command data structure that includes all of the command components necessary to construct commands used with the present invention. Specifically, this structure is used to send any one of the NameField, AddressField, and LocalityField Commands to the NameField, AddressField and LocalityField processes, respectively.

Regardless of which of the three parallel branches traversed, NameField, AddressField or LocalityField, the first process performed as a result of a command will be the text normalization process indicated by blocks 210, 220 and 230 in FIG. 3.

Figure 4:
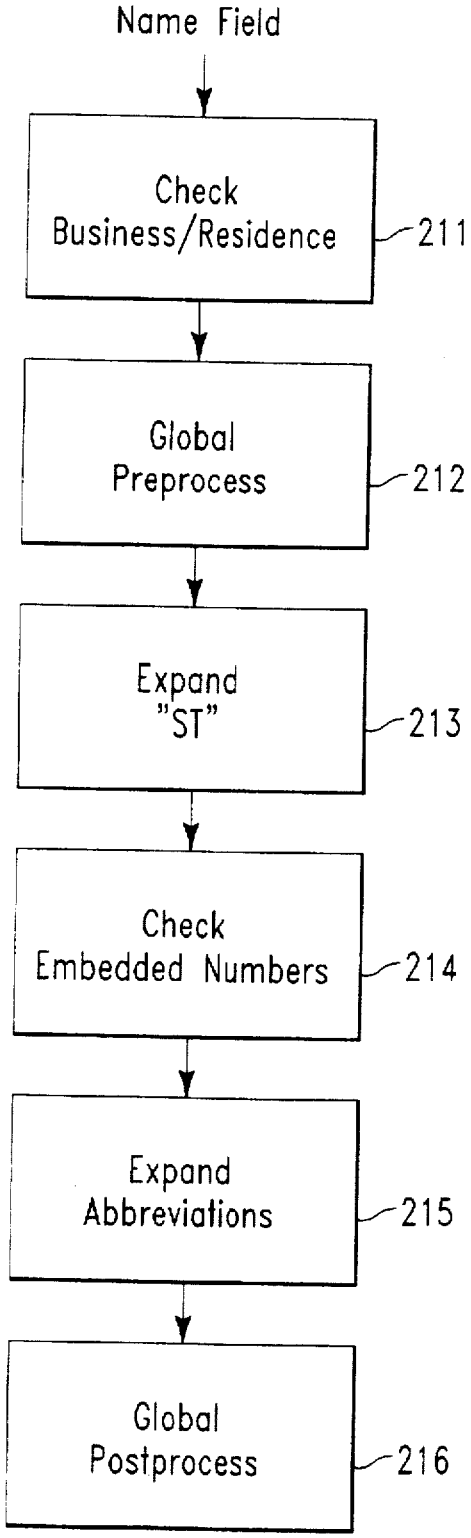
FIG. 4 is a flow diagram showing the steps performed by the present invention in processing a name field portion of a database entry.

With reference to FIG. 4, NameField text normalization proceeds through the following steps: Business/Residence Check 211, Global Preprocessing 212, Expansion of "ST" 213, Embedded Number Check 214, Abbreviation Expansion 215, and Global Postprocess 216.

Figure 5:
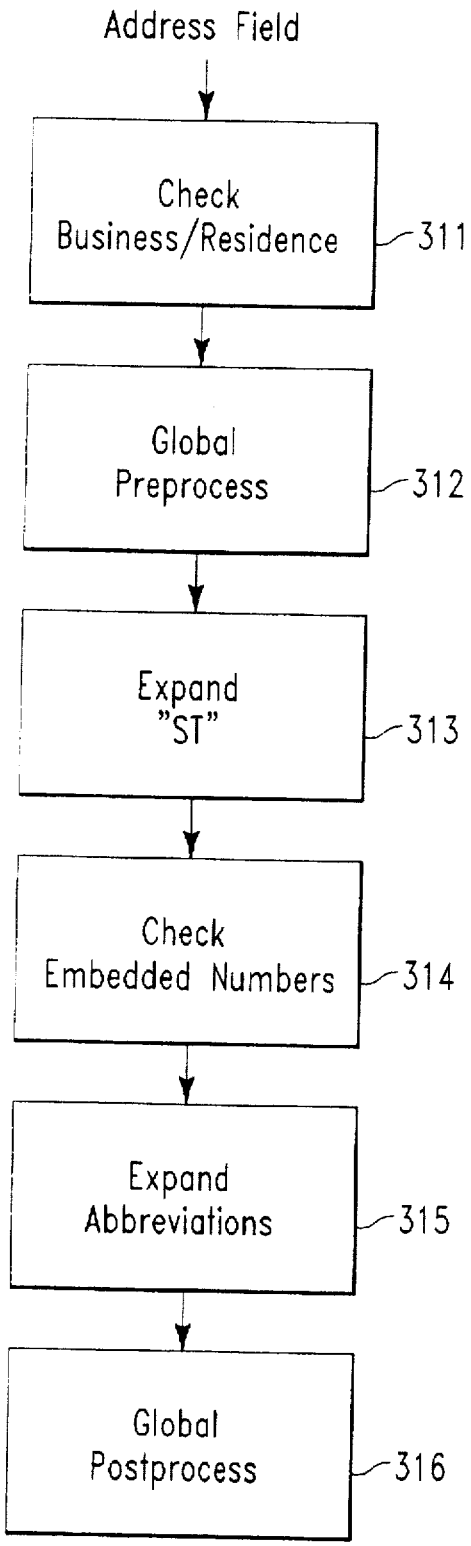
FIG. 5 is a flow diagram showing the steps performed by the present invention in processing an address field portion of a database entry.

Address field and Locality field processing proceeds similarly. With reference to FIG. 5, AddressField text normalization proceeds through the following steps: Business/Residence Check 311, Global Preprocessing 312, Expansion of "ST" 313, Embedded Number Check 314, Abbreviation Expansion 315, and Global Postprocess 316.

Figure 6:
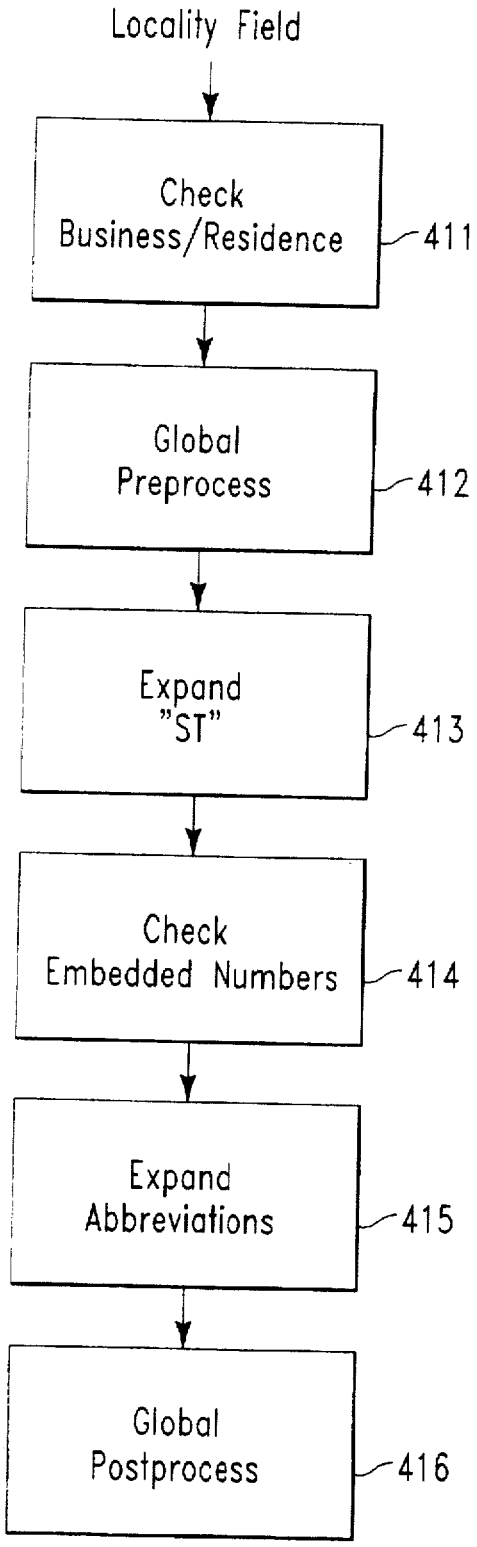
FIG. 6 is a flow diagram showing the steps performed by the present invention in processing a locality field portion of a database entry.

Finally, and with reference to FIG. 6, LocalityField text normalization proceeds through the following steps: Business/Residence Check 411, Global Preprocessing 412, Expansion of "ST" 413, Embedded Number Check 414, Abbreviation Expansion 415, and Global Postprocess 416.

While each of these three separate, parallel paths are similar in their processing, it is important to realize that not all applications require all of the steps shown in FIGS. 4, 5, and 6 for each of the Name Field, Address Field, and Locality Field, respectively. As such, before any normalization takes place on a NameField, AddressField or LocalityField, a configuration file 1600, shown in FIG. 2, is read to determine which application-specific steps shown in FIGS. 4, 5 and 6 are in fact utilized.

Those skilled in the art can readily appreciate that the use of a configuration file allows an application a tremendous amount of flexibility. In particular, the application reads the configuration file, which in turn instructs the application how to process a given database. Therefore, a single application can be advantageously tailored to process widely varying databases through a simple modification to the configuration file. No re-editing or re-compiling of the application is required. A skeletal configuration file is shown in FIGS. 12*a* and 12*b*.

FIG. 9 shows a data structure and members which are used by the Normalize NameField process depicted in FIG. 4. In particular, phone_num_info 902, contains optional information which may be appended/prepended to telephone_num, 904. A name of a particular speech synthesizer is identified in a synthesizer_name field, 906. This synthesizer_name field permits the present invention to interact with different speech synthesizers and provide synthesizer specific processing, where necessary.

In some applications the name field is pre-split into a family and given name fields. Therefore a listing_name field, 908, holds the entire name field extracted from the data base being read and a Boolean member, found_joint_name 910, identifies whether the listing_name is a joint name. Further, some applications may have links to other structures. Therefore a DBA_link 916, a care_of_link 918 and an attention_link 920 is provided for names doing business as, in care of, and attention of, respectively.

Finally, additional information may be contained within a data base, therefore, a directive_text member 922 provides, i.e., hours of business, while a listing_type member 924 permits the identity of a business or residence, if it is known.

Likewise, and with reference to FIG. 7, a data structure and component members used to send a Normalize_Addr_Text command is shown. Specifically, a telephone_num member 702, holds 10 digits which represent the telephone number. A addr member 704 identifies a complete street address. In those applications where various components of an address are known, a house_num member 706, a street-name member 708, a street_type member 710 and a street_suffix member 712 are provided. Those skilled in the art can appreciate that house_num is typically, i.e., in the C programming language, of type CHAR instead of INT because house numbers could be, i.e., 12A, N, NE, etc. The street_type member identifies, i.e., ST, Street, Avenue, PKWY etc., while the street_suffix member identifies, e.g., an extension.

Lastly, and with reference to FIG. 8, the data structure and component members used to send a Normalize_Locality_Text command are shown. In particular, a telephone_num member 802, city member 804, state member 806, zip_code member 808, and zip_plus_four member 810 are used to identify the 10 digit telephone number, city, 5 digit zip-code and the last 4 digits in a zip+4 number, respectively.

As previously stated and should now be apparent, the three separate paths, (NameField, AddressField, LocalityField) are all processed in parallel and proceed through similar steps. As such, I will now describe the steps by which the NameField, AddressField and LocalityField are all commonly processed.

Referring now to FIGS. 3 and 4, after the Intelligent Field Recognizer 100 identifies an individual NameField, AddressField and LocalityField within a previously input source listing 1, the three fields are sent through NameField branch 235, AddressField process 215, and LocalityField branch 245, respectively.

Each of the three processes first checks whether the listing is a business listing or a residence listing. This business/residence determination is made by, and with reference to FIG. 2, a Business/Residence Identifier module 1500.

The Business/Residence Identifier module uses a keyword look up methodology in combination with a set of simple rules, e.g., the presence of an apostrophe character "'" as in DENNY'S PLACE, to determine whether a listing is a business listing or a residence listing. Correct Business/Residence classification influences subsequent processing.

In particular, correct abbreviation expansion is context-sensitive. Therefore it is useful to know whether a listing is a business listing or a residence listing. For example, the word HO in the name field of a residence listing, e.g., THAN VIET HO, should be left alone while it should be expanded to HOSPITAL in business listings, e.g., ST VINCENT'S HO. Correct expansion of the abbreviation ST in name fields frequently depends upon correct business/residence identification as well.

As an example of business/residence identification, consider Examples 1 and 2 shown previously. Within these examples, the presence of the key word AUDIO in Example 1 and BROADCASTING in Example 2 identify those two listings as businesses, respectively.

After the business/residence identification is checked, global preprocessing 212, 312, 412 begins. In particular, global preprocessing resolves context sensitive information (text substitution) contained within the NameField, AddressField and LocalityField. It accepts a field; the business/residence identifier; an area code (since we are primarily dealing with telephone listings); a list of context sensitive rules in a table having a form of: regular expression::substitution string; and a table of rules and produces as output a field with context-sensitive text substitution.

Global preprocessing is effected through the use of one or more rule files, namely rule files of regular expressions, rule files of non-regular expressions and files of special character rules. Global preprocessing corrects simple typographic errors and processes a number of special characters. For example, the slash character "/" or "\" is oftentimes found in existing databases. When our global preprocessor encounters such a slash character in an entry, e.g., "12 ½ ST", that entry is translated to "12 1 by 2 street."

Subsequent to global preprocessing, occurrences of "ST" are then expanded by blocks 213, 313, and 413. Expansion of ST is extremely context dependent and a simple approach to the expansion of ST is to expand it to "saint" when it precedes another word (ST. PAUL) and to "street" when it follows another word (PAUL ST.) Unfortunately, in a real database, many more complicated cases occur and the simple "preceding/following" rule previously recited for ST fails when it appears between two words as in ROBERT ST GERMAIN (Saint), MAIN ST GROCERIES (Street), and NY ST ASSEMBLY (State).

The approach taken by the ST expansion block is to use a different substitution depending upon a location of the ST in the field. In particular, there is a set of substitutions when ST occurs as a first token in a field, a second set of substitutions when ST occurs as a last token in a field, and a third set of substitutions when ST occurs as a token not in either of the first two sets.

And while this greatly reduces the complexity of ST expansion, it does not altogether remove all ambiguity. Therefore our invention further resolves this expansion by building semantic classes of words, and uses a word's membership in these classes as contextual features to further choose between alternative mappings. The mapping of ST, for instance, is determined by a number of rules. In the example above, GROCERIES is a member of the class "BUSINESSES", which includes GROCERIES, VARIETY, RECORDING, CLEANER, SPORTSWEAR, COMPANY, STORE, PHARMACY, THEATER, BOOKS and REPAIR. When ST occurs between any two words, then if the word to the right of ST is a business, the mapping to "street" is chosen. A skeletal set of mappings for ST is shown in FIG. 13*a*.

After occurrences of "ST" are expanded, a check is made for embedded numbers contained within the NameField, AddressField and LocalityField in blocks 214, 314, and 414 respectively.

Once any embedded numbers are identified within the individual fields, the fields are then processed by abbreviation expansion blocks 215, 315, and 415. The abbreviation expansion proceeds similarly to the expansion of ST as described previously. In particular, a table of common abbreviations is compared with the text contained within a particular field, and if a match is found in the abbreviation table and the context is appropriate, then the abbreviation is substituted with any appropriate text contained within the table.

Lastly, text normalization proceeds through global postprocessing steps 216, 316, and 416. As with the global preprocessing steps discussed previously, global postprocessing uses both regular expressions and non-regular expressions to resolve any remaining ambiguities and to correct mistakes made in earlier processing.

Specifically, the global postprocessing step receives as input a field to process, an indication of whether a particular listing is a business and a list of context sensitive rules in a table, and outputs the field having additional context-sensitive text substituted therein. In particular, embedded "CO" is generally substituted with "COMPANY" while "AAA" is substituted with "TRIPLE A" and "AA" is substituted with "DOUBLE A".

Once the global postprocessing is finished, text normalization is complete. Examples of completed text normalization processing for NameField, AddressField and LocalityField fields are shown in Examples 3, 4, and 5 respectively.

| INPUT | OUTPUT |
|---|---|
| Example 3. | |
| WM DOUGLAS ROBINSON DBA ROBINSON AUDIO +VDO | WILLIAM DOUGLAS ROBINSON DOING BUSINESS AS ROBINSON AUDIO AND VIDEO |
| WSKQ SPANISH BROADCASTING | WSKQ SPANISH BROADCASTING |
| Example 4. | |
| 120 ST PAUL ST 26 W 56, FLR 5 | 120 SAINT PAUL STREET 26 WEST 56, FLOOR 5 |
| Example 5. | |
| WRJC | WHITE RIVER JUNCTION |

Upon completion of text normalization, the parallel processing of the individual fields continues with acronym detection in blocks 310, 320, 330. Acronynm detection uses a combination of rules and table look-up to identify known acronyms. In addition to identifying the acronyms, this block distinguishes those acronyms found by outputting them in a distinguishing font, e.g., all lower case.

Lastly, our invention identifies those words contained within the database which are to be spelled out. Spell marking on each of the three fields is performed by blocks 410, 420, 430. In particular, the last name of a person contained within a NameField is marked for spelling. A first name of a person may be marked for spelling if it is determined that the first name meets a particular set of rules, which are known in the art. For example, if the first name has a five-consonant cluster, the spell marker determines that the name is "complex" and tags it to be spelled. Other algorithmic approaches such as the one disclosed by Spiegel, et al, *Development of the ORATOR Synthesizer for Network Applications: Name Pronunciation Accuracy, Morphological Analysis, Customization for Business Listings, and Acronym Pronunciation*, AVIOS Proceedings, pp. 169–178, 1990, have been used to generate a list of "unpronounceable" words.

Upon completion of each of the NameField, AddressField, and LocalityField processing, each of the processed fields are sent to output formatter 500, where the now processed listing is re-assembled and then sent to text-to-speech equipment for speech synthesis.

Clearly, it should now be quite evident to those skilled in the art, that while our invention was shown and described in detail in the context of a preferred embodiment, and with various modifications thereto, a wide variety of other modifications can be made without departing from scope of my inventive teachings.

We claim:

1. A method for processing text contained within a database for subsequent synthesis by a text-to-speech synthesizer comprising the steps of:

inputting a listing from a database containing the text to be processed;

parsing the text into one or more distinct fields;

processing in parallel and generating an output for each of the distinct fields wherein said parallel processing includes the steps of:

i) normalizing the text contained within each of the fields utilizing both regular expressions to normalize the text and non-regular expressions to normalize the text;

ii) detecting acronyms contained within the text;

iii) identifying text which is to be spelled-out by the text-to-speech synthesizer; and combining the output of each of the parallel processing steps into a single output, for presentation to the text-to-speech synthesizer.

2. The method according to claim 1 wherein said parsing step produces a Name Field, an Address Field and a Locality Field.

3. The method according to claim 1 wherein said step of normalizing the text contained in each of the fields includes a sub-step of checking for embedded numbers.

4. A device for processing textual data contained within a database for subsequent synthesis by a text-to-speech synthesizer such that resultant speech is enhanced, said device comprising:

a computer processor;

a control module including at least one application for execution by the computer processor;

a collection of processing tables and processing rules for use by the computer processor in processing the textual data within the database;

a start up module in communication with said control module and said collection of tables and rules, for execution by the computer processor to initialize said tables prior to processing said text;

a configuration file for execution by the computer processor to configure the at least one application;

a set of tools in communication with said at least one application, said tables and rules and said configuration file, said set of tools including:

an intelligent field recognizer for generating a plurality of fields of text from the textual data contained within the database;

a plurality of field normalizer modules, one for each field generated, for normalizing the fields of text generated by the intelligent field recognizer;

an acronym detector module for detecting acronyms contained within the normalized fields of text generated by the plurality of field normalizer modules;

means, in communication with the at least, one application and the tables a rules, for determining whether the textual data is a business listing or a residence listing; and an output formatter for generating formatted fields of text after the fields of text have been normalized by the field normalizers and have had acronyms detected by the acronym detector;

wherein said formatted fields of text are presented to the text-to-speech synthesizer for producing speech corresponding to the textual data processed.

5. The device according to claim 4 wherein said plurality of normalizer modules further comprise a Name Field text normalizer module, an Address Field text normalizer module and a Locality Field text normalizer module.

6. The device according to claim 5 wherein said Name Field text normalizer module uses a data structure which comprises: phone_num_info, telephone_num, synthesizer_name, listing_name, family_name, given_name, DBA_link, care_of_link, attention_link, directive_text and listing_type.

7. The device according to claim 5 wherein said Address Field text normalizer module uses a data structure which comprises: a telephone_num, address, house_num, streetname, street_type and street_suffix.

8. The device according to claim 5 wherein said Locality Field text normalizer module uses a data structure which comprises: telephone_num, city, state, zip_code, and zip_plus_four.

* * * * *